US006462471B1

(12) United States Patent
Komiya et al.

(10) Patent No.: US 6,462,471 B1
(45) **Date of Patent: *Oct. 8, 2002**

(54) HIGH PRESSURE MERCURY LAMP PROVIDED WITH A SEALING BODY MADE OF A FUNCTIONAL GRADIENT MATERIAL

(75) Inventors: Masanobu Komiya, Himeji; Yukihiro Morimoto, Mishima; Akihiko Sugitani, Himeji, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/453,445

(22) Filed: Dec. 3, 1999

(51) Int. Cl.[7] ..... H01J 17/20; H01J 61/12

(52) U.S. Cl. ..... 313/571; 313/623; 313/624; 313/625; 313/639; 313/642

(58) Field of Search ..... 313/623, 624, 313/625, 639, 642, 571, 631

(56) References Cited

U.S. PATENT DOCUMENTS

| | | | | |
|---|---|---|---|---|
| 4,881,009 A | | 11/1989 | Passmore | 313/631 |
| 4,959,587 A | | 9/1990 | Schug | 313/623 |
| 5,109,181 A | | 4/1992 | Fischer et al. | 313/571 |
| 5,497,049 A | | 3/1996 | Fischer | 313/634 |
| 5,932,969 A | * | 8/1999 | Ikeuchi et al. | 313/623 |
| 6,060,830 A | * | 5/2000 | Sugitani et al. | 313/571 |
| 6,175,188 B1 | * | 1/2001 | Morimoto et al. | 252/570 |

FOREIGN PATENT DOCUMENTS

| | | |
|---|---|---|
| DE | 92 06 727.1 | 8/1992 |
| EP | 0 338 637 | 10/1989 |
| EP | 0 650 184 | 4/1995 |
| JP | 8-138555 | 5/1996 |
| WO | WO 9917339 A1 * | 4/1999 ..... H01J/61/36 |

OTHER PUBLICATIONS

Patent Abstracts of Japan, vol. 1998, No. 10, Aug. 31, 1998 & JP 10 125284 A, Toto Ltd., May 15, 1998 English Abstract.

Patent Abstracts of Japan, vol. 1996, No. 08, Aug. 30, 1996 & JP 08 096750 A, Toshiba Lighting & AMP; Technol Corp., Apr. 12, 1996, English Abstract.

Patent Abstracts of Japan, vol. 1996, No. 09, Sep. 30, 1996, & JP 08 138555 A, Toto Ltd, May 31, 1996, English Abstract.

* cited by examiner

*Primary Examiner*—Nimeshkumar D. Patel
*Assistant Examiner*—Mariceli Santiago
(74) *Attorney, Agent, or Firm*—Nixon Peabody LLP; David S. Safran

(57) ABSTRACT

A super-high pressure mercury lamp with an internal pressure during operation of one hundred and some dozen atm, which has a new arrangement in which in the hermetically sealed portions neither damage the lamp nor shortening its operating service life is achieved, in a high pressure mercury lamp in which a silica glass discharge vessel contains a pair of spaced apart, opposed electrodes and which is filled with a rare gas and with mercury in an amount of greater than or equal to 0.16 mg/mm$^3$, and in which the wall load is greater than or equal to 0.8 W/mm$^2$, is achieved in that a side tube part formed on each end of this discharge vessel is provided with a sealing body that is made of a functional gradient material which is formed essentially of a dielectric material and an electrically conductive material with a ratio to one another which changes in the lengthwise direction of the sealing body, between a dielectric end area and an electrically conductive end area, the dielectric end area being connected to the side tube and the electrically conductive end area being connected to an outer electric lead.

2 Claims, 4 Drawing Sheets

HIGH PRESSURE MERCURY LAMP PROVIDED WITH A SEALING BODY MADE OF A FUNCTIONAL GRADIENT MATERIAL

BACKGROUND OF THE INVENTION

1. Field of the Invention

The invention relates to a high pressure mercury lamp. The invention relates especially to a super-high pressure mercury lamp in which a discharge vessel is filled with mercury in an amount greater than or equal to 0.16 mg/mm$^3$, in which furthermore the mercury vapor pressure during operation is greater than or equal to a hundred and some dozen atm, and which is used as a backlight of a liquid crystal display device or the like.

2. Description of Related Art

In a liquid crystal display device of the projection type there is a need for uniform illumination of images onto a rectangular screen with adequate color reproduction.

Therefore, a metal halide lamp which is filled with mercury and a metal halide is used as the light source. Furthermore, smaller and smaller metal halide lamps, and more and more often point light sources have recently been produced, and lamps with extremely small distances between the electrodes have been used in practice.

Against this background, instead of metal halide lamps, lamps with an extremely high mercury vapor pressure, for example, with a vapor pressure greater than or equal to 200 bar (roughly 197 atm), have recently been proposed. Here, the increased mercury vapor pressure suppresses broadening of the arc (the arc is contracted) and a considerable increase of the light intensity is desired; this is disclosed, for example, in Japanese patent disclosure document HEI 2-148561 (U.S. Pat. No. 5,109,181) and in Japanese patent disclosure document HEI 6-52830 (U.S. Pat. No. 5,497,049).

Japanese patent disclosure document HEI2-148561 (U.S. Pat. No. 5,109,181) discloses a high pressure mercury lamp in which a discharge vessel which has a pair of tungsten electrodes is filled with a rare gas, greater than or equal to 0.2 mg/mm$^3$ mercury and halogen in the range from $1\times10^{-6}$ to $1\times10^{-4}$ $\mu$mol/mm$^3$, and which is operated with a wall load of greater than or equal to 1 W/mm$^2$.

The reason for the amount of mercury added being greater than or equal to 0.2 mg/mm$^3$ is to raise the mercury pressure, to multiply the continuous spectrum in the visible radiation range, especially in the red range, and to improve the color reproduction. The reason for the wall load of greater than or equal to 1 W/mm$^2$ is to increase the temperature in the coolest portion in order to increase the mercury pressure.

On the other hand, Japanese patent disclosure document HEI 6-52830 (U.S. Pat. No. 5,497,049) discloses that, in addition to the above described amount of mercury, the value of the wall load, the amount of halogen, the shape of the discharge vessel, and the distance between the electrodes are fixed.

It is stated that this lamp is suited for a light source for a projector. Furthermore, it is described herein that the degree of maintenance of the screen illuminance is greater than when using a conventional lamp.

The lamps disclosed in the above described publications of the prior art each have a foil seal arrangement which is shown in FIG. 6. In the figure, a discharge vessel 61 has a hermetically sealed portion 62 formed on each of its two ends and in which a metal foil 63 made of molybdenum or the like is inserted. An electrode 64 is connected to the side of the respective metal foil 63 which points into the discharge vessel 61, while an outer lead 65 is connected to its side which points toward the exterior. FIG. 7 is a cross section taken along line 7—7 in FIG. 6. Between the metal foil 63 and the electrode 64, a gap S inevitably forms.

Since this mercury lamp has a very high internal pressure of one hundred and some dozen atmospheres during operation, as was described above, cracks often form leading from the gap S; this also leads to damaging of the lamp and shortening of the operating service life.

SUMMARY OF THE INVENTION

Therefore, a primary object of the present invention is to devise a super-high pressure mercury lamp with an internal pressure during operation of one hundred and some dozen atm, which has a new arrangement in which in the hermetically sealed portions neither damage the lamp nor shorten its operating service life.

In a high pressure mercury lamp in which a silica glass discharge vessel contains a pair of electrodes opposite one another, which is filled with mercury in an amount of greater than or equal to 0.16 mg/mm$^3$ and rare gas, and in which the wall load is greater than or equal to 0.8 W/mm$^2$, the above object is achieved in accordance with the invention in that a side tube part is formed on each end of this discharge vessel which has a sealing body formed of a functional gradient material which is formed essentially of a dielectric material and an electrically conductive material with a ratio to one another which changes in the lengthwise direction of the sealing body, and which has a dielectric end area and an electrically conductive end area, and in that the sealing body in its dielectric end area is connected to the side tube and is connected to the electrode at its electrically conductive end area.

The object is furthermore advantageously achieved according to the invention when the high pressure mercury lamp has the above described arrangement and the condition $a/b \leqq 0.25$ is met, where a is the value of the outside diameter on the end face of the sealing body on the side of the discharge vessel and b is the value of the outside diameter of the side tube in this area.

In the following the invention is further described using several embodiments which are shown in the drawings.

DETAILED DESCRIPTION OF THE INVENTION

The high pressure mercury lamp in accordance with the present invention is characterized by the hermetically sealed portion being provided with a sealing body of a functional gradient material to achieve the object of the invention, i.e., to devise a new hermetically sealed arrangement in which neither damage to the lamp nor shortening of the operating service life are caused.

Figure 1:
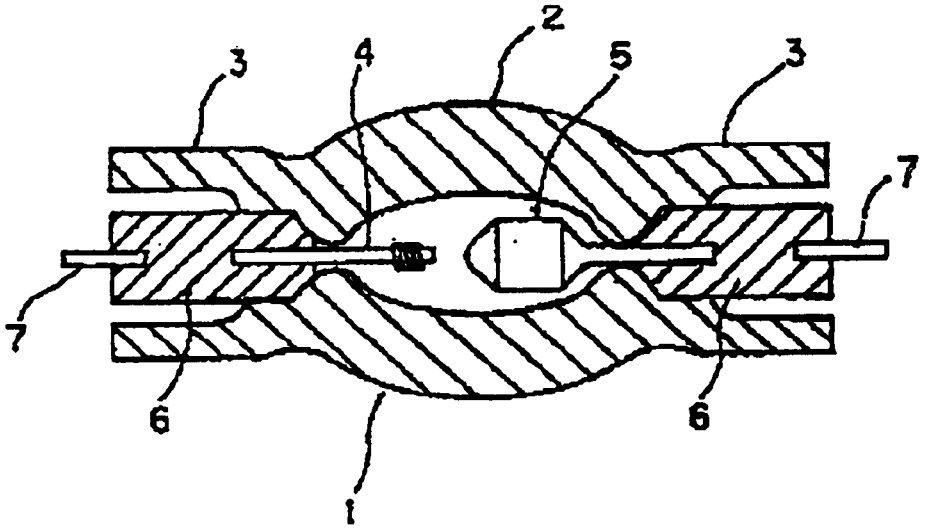
FIG. 1 is a schematic cross-sectional view of a high pressure mercury lamp in accordance with an embodiment of the invention.

FIG. 1 schematically shows a high pressure mercury lamp according to the invention in which a silica glass mercury lamp 1 has a discharge vessel 2 in the middle. Narrow side tubes 3 are connected to the two ends of the discharge vessel 2. In the discharge vessel 2 (hereinafter also called the "emission space"), there are an anode 4 and a cathode 5 spaced from each other at a distance of roughly 1.2 mm. The back ends of the anode 4 and the cathode 5 are each welded to a sealing body 6 in the side tube 3. Furthermore, an outer lead 7 projects outwardly from the sealing body 6.

The emission space is filled with mercury as the emission material and a rare gas, such as argon, xenon or the like, as the starter gas for operation. The amount of mercury added is at least equal to 0.16 mg/mm$^3$, by which the vapor pressure during stable operation is at least one hundred and some dozen atmospheres. By the measure that the amount of mercury added is at least 0.16 mg/mm$^3$, the mercury pressure can be raised, the continuous spectrum in the visible radiation range, especially in the red range, can be multiplied, and the color reproduction can be improved. Furthermore, by the measure that wall load is at least 0.8 W/mm$^2$, the temperature in the coolest portion of the arc tube can be increased until the temperature necessary to increase the mercury pressure is reached.

Furthermore, a halogen such as bromine, iodine or the like can be added. In this way, using the so-called halogen cycle phenomenon, the operating service life can be prolonged.

Figure 2:
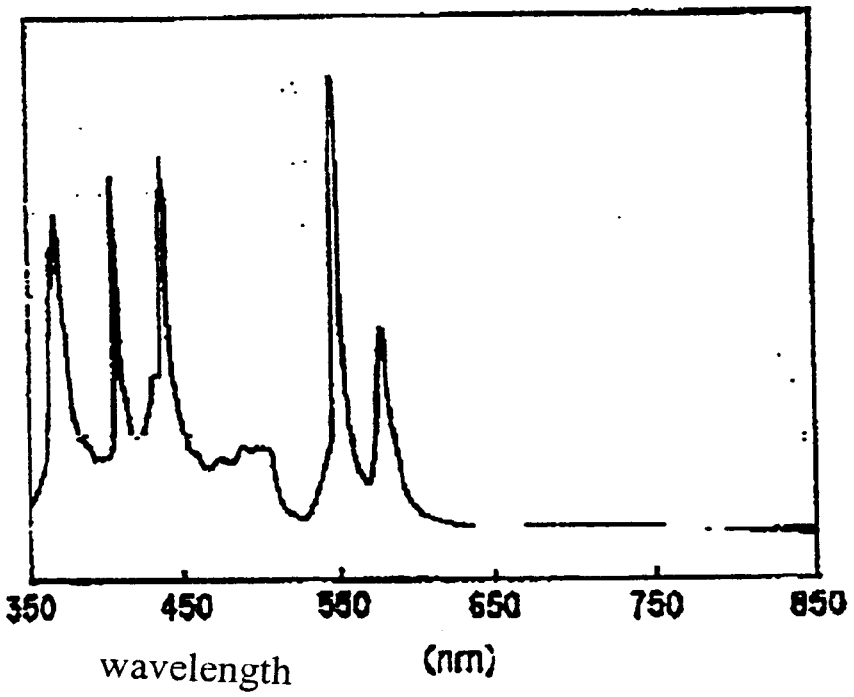
FIG. 2 depicts the spectral distribution through the high pressure mercury lamp according to the invention.

FIG. 2 shows the spectral distribution in the above described high pressure mercury lamp.

As the figure shows, in the area of visible radiation with wavelengths of roughly 380 to 780 nm effective radiation is obtained. In particular, in the red range with wavelengths from 600 to 780 nm continuous radiation occurs to a large extent, which in comparison to a lamp containing less than or equal to 0.05 mg/mm$^3$ of mercury added was clearly multiplied.

Figure 3:
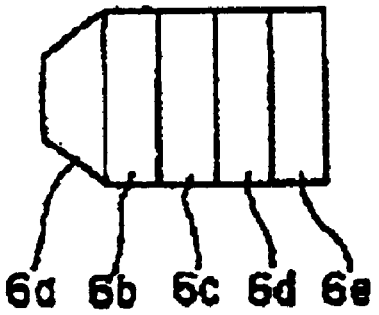
FIG. 3 shows a sealing body of the high pressure mercury lamp of the invention.

The sealing body 6 has, as is shown in FIG. 3, a essentially cylindrical overall shape. Its end which points towards the emission space is tapered. This sealing body 6 is essentially made up of a dielectric component and an electrically conductive component. It is formed, for example, in such a way that a layer 6*a* with a ratio of molybdenum to silicon dioxide of 0:100, a layer 6*b* with a ratio of molybdenum to silicon dioxide of 25:75, a layer 6*c* with a ratio of molybdenum to silicon dioxide of 50:50, a layer 6*d* with a ratio of molybdenum to silicon dioxide of 75:25, and a layer 6*e* with a ratio of molybdenum to silicon dioxide of 100:0, follow one after the other. This means that the mixing ratio of molybdenum and silicon dioxide differs in the direction from the mixed layer 6*a* to the mixed layer 6*e* gradually or incrementally. Also the property of the sealing body 6 itself thus has a functional gradient. One such sealing body is formed, for example, with a length of 22 mm and an outside diameter of 3 mm. The layer 6*e* with a percentage by weight of the silicon dioxide component of 0% and a percentage by weight of the molybdenum component of 100% is located outside the discharge vessel. The connection to the outer lead 7 takes place in this area. The layer 6*a* with 100% of the silicon dioxide component is connected to the side tube. The ratios of the composition and the number of layers are however not unconditionally limited to the above described numerical values.

These sealing bodies with a functional gradient are produced by weighing out powders of the electrically conductive component (molybdenum) and the dielectric component (silicon dioxide) while changing of the mixing ratio in the above described manner. More accurately, there are two powders, not mixed powders, since here the other powder at the time is mixed in with 0%. For the sake of simplicity however also these powders are called "mixed powders." The five mixed powders which have been produced in this way are compressed. This compression takes place in that the above described mixed powders are gradually mixed into a compression casting mold in a sequence in which one of the two components increases quantitatively. The sealing body is made by sintering the whole. One such sealing body formed of a functional gradient material is disclosed, for example, in published Japanese Patent Application HEI 8-138555.

Besides molybdenum, nickel, tungsten, tantalum, chromium or the like can be used as the electrically conductive component. Besides silicon dioxide, aluminum oxide, zirconia, magnesium oxide, silicon carbide, titanium carbide or the like can be used as the dielectric component.

Nor is the number of layers limited to five, but for example, even more layers can be formed. Furthermore, if necessary, instead of molybdenum powder, nickel powder, and instead of silicon dioxide powder, borosilicate glass powder can be mixed in as the binder.

By joining the sealing body with a functional gradient to the side tube of the discharge vessel in the above described manner, a perfect hermetic seal can be achieved, and at the same time, also a feed arrangement can also advantageously be devised inside and outside of the discharge vessel.

In this sealing body with a functional gradient, formation of a microscopically small space between the upholding part of the electrode and the metal foil, as is the case in a foil-seal arrangement, is prevented. This also prevents formation of cracks proceeding from this area.

Figure 4:
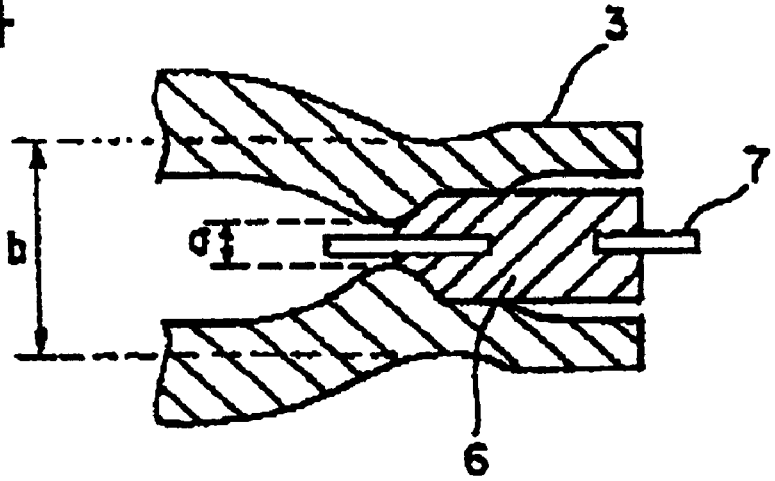
FIG. 4 is an enlarged cross section of the hermetically sealed arrangement of the high pressure mercury lamp in accordance with the invention.

As was described above, in accordance with the invention, the compressive strength can be increased by a sealing body with a functional gradient acting as the hermetically sealed component. The feature in accordance with the invention that a/b is established where a is the value of the outside diameter on the end face of the sealing body 6 on the side of the discharge vessel and b is the value of the outside diameter of the side tube in this area, makes it possible to increase the compressive strength even more, as is shown in FIG. 4.

The reason for establishing a/b in this way is that there are cases in which cracks form at the location at which the end face of the sealing body on the side of the discharge vessel and the side tube of the discharge vessel are welded to one another, although by using the sealing body with a functional gradient, the compressive strength can be sufficiently increased.

Rigorous studies have found that the compressive strength can be increased even more by the fact that the thickness of the side tube with respect to the end face of the sealing body 6 on the side of the discharge vessel is made relatively large, and it was found that as a result thereof formation of cracks can be reduced even more.

Specifically, the invention is furthermore characterized in that the ratio a/b is less than or equal to 0.25 where a is the value of the outside diameter on the end face of the sealing body 6 on the side of the discharge vessel and b is the value of the outside diameter of the side tube in this area.

Figure 5:
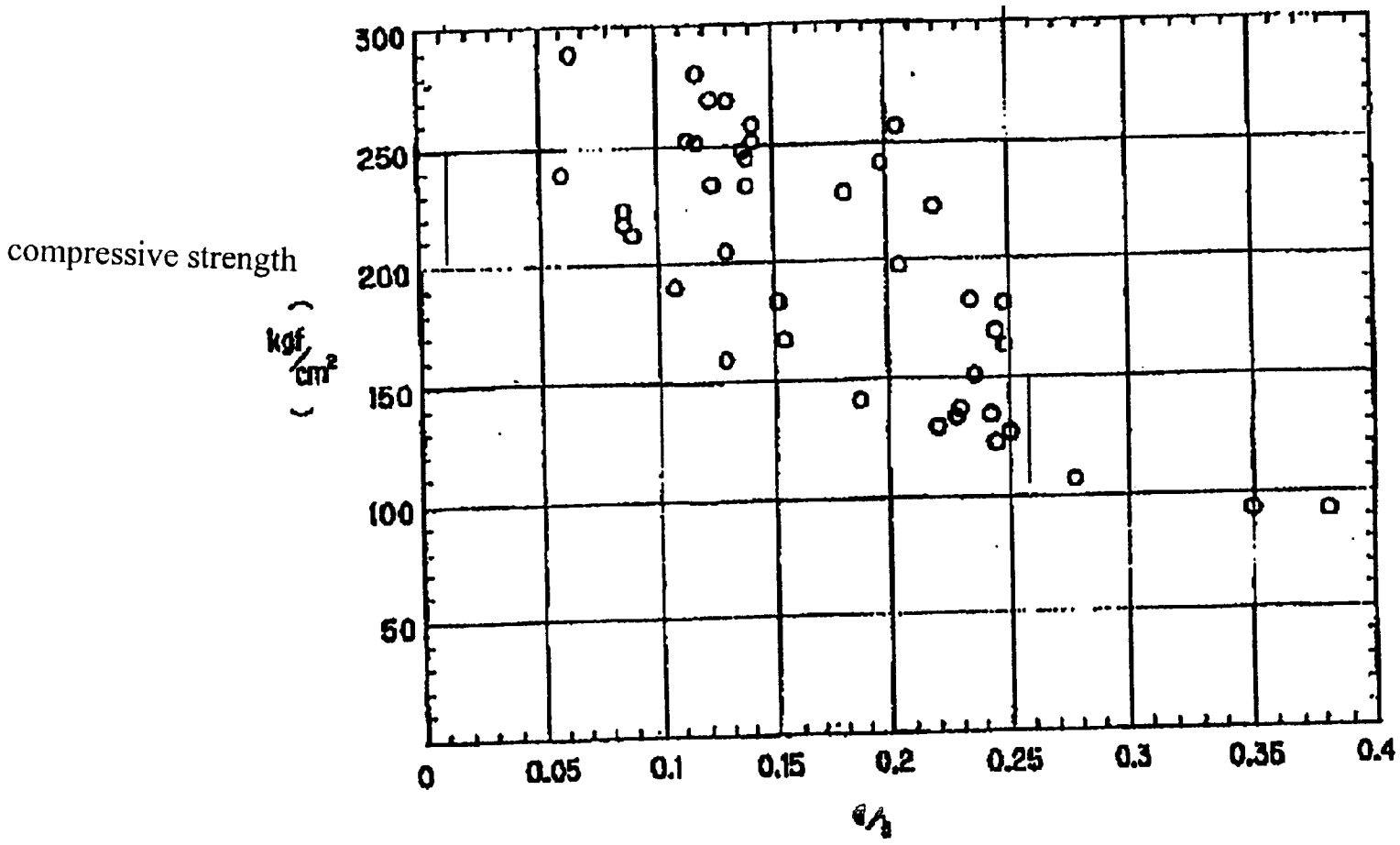
FIG. 5 is a graph depicting the results of tests which show the action of the invention.
Figure 6:
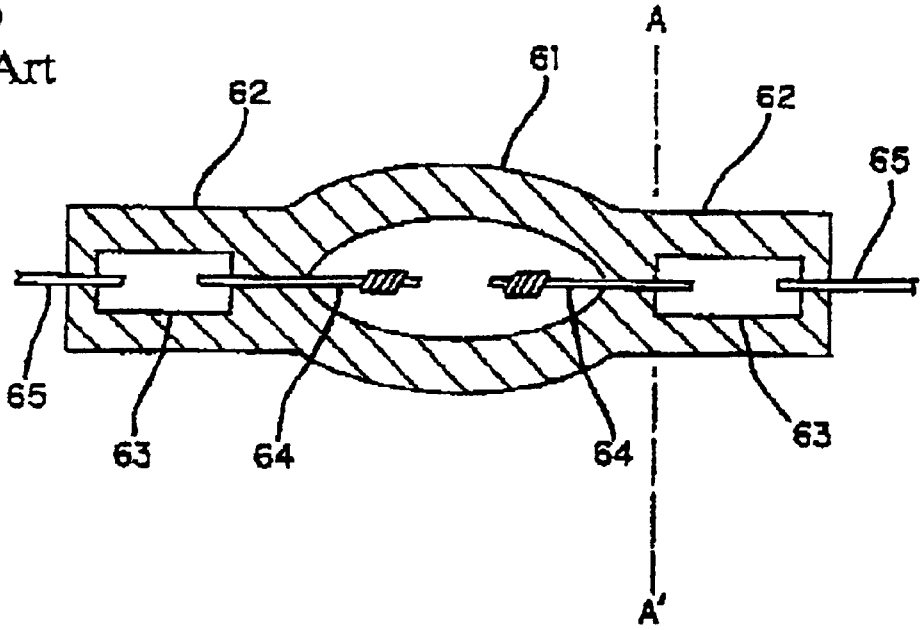
FIG. 6 Prior Art
FIG. 6 is a schematic representation of a conventional high pressure mercury lamp.
Figure 7:
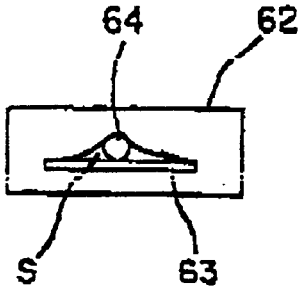
FIG. 7 Prior Art
FIG. 7 is a cross section taken along line A–A' in FIG. 6.

FIG. 5 shows the compressive strength when the value a/b changes from 0.06 to 0.38. The x-axis plots the value of a/b while the y-axis plots the compressive strength. The test was run in the following manner:

The sealing body 6 was sealed in the silica glass tube such that the dimension of a differs. The dimensions of a and b were measured. Afterwards gas was pressed in from the side of the discharge vessel. The numerical values were read off when destruction occurred.

As is apparent in the drawings, the compressive strength is greater at least 130 atm when the value of a/b does not exceed 0.25; this is suitable for the super high-pressure mercury lamp in accordance with the invention.

The high pressure mercury lamp according to the invention is not limited to only a lamp of the dc operating type, but it can also be a lamp of the ac operating type.

ACTION OF THE INVENTION

As was described above, in a high pressure mercury lamp in which in a silica glass discharge vessel contains a pair of electrodes and is filled with mercury in an amount of greater than or equal to 0.16 $mg/mm^3$ and rare gas, and in which the wall load is at least 0.8 $W/mm^2$, the object of the invention is achieved in that, on each end of this discharge vessel, a side tube part is made which has a sealing body formed of a functional gradient material, which is essentially composed of a dielectric material and a electrically conductive material with a ratio to one another which changes in the lengthwise direction of the sealing body, and which has a dielectric end area and an electrically conductive end area, and in that the sealing body in its dielectric end area is connected to the side tube and in its electrically conductive end area it is connected to the outer lead.

This arrangement can advantageously eliminate the defect in a foil-seal sealing arrangement, specifically the formation of cracks. Thus, a mercury lamp with high compressive strength can be devised.

Furthermore, the object can be advantageously achieved in accordance with the invention by condition $a/b \leqq 0.25$ being met, where a is the value of the outside diameter on the end face of the sealing body 6 facing into the discharge vessel and b is the value of the outside diameter of the side tube in this area. The compressive strength can be increased even more by this arrangement even if the sealing body has a functional gradient.

What we claim is:

1. High pressure mercury lamp comprising a silica glass discharge vessel containing a pair of opposed, spaced apart, electrodes, a rare gas and mercury in an amount of at least equal to 0.16 $mg/mm^3$, a wall load on the vessel being at least equal to 0.8 $W/mm^2$; wherein a side tube part is formed on each end of the discharge vessel; and wherein a sealing body is provided that is formed of a functional gradient material, the sealing body having a inner end area formed of dielectric material and an outer end area formed of electrically conductive material, the dielectric inner end area being connected to the side tube and the conductive outer end area of the sealing body being connected to an outer lead; and wherein the functional gradient material has a ratio of dielectric material to electrically conductive material which changes in a lengthwise direction of the sealing body from the dielectric inner end area to the conductive outer end area.

2. High pressure mercury lamp as claimed in claim 1, wherein a value a of an outside diameter on an end face of the sealing body directed toward the discharge vessel and a value b of an outside diameter of the side tube in an area of said end face fulfill the relationship with respect to each other of $a/b \leqq 0.25$.

* * * * *